US008573009B2

(12) United States Patent
Ekbundit et al.

(10) Patent No.: US 8,573,009 B2
(45) Date of Patent: Nov. 5, 2013

(54) BASKET ASSEMBLY WITH FLUID VANES FOR A STEAM-AUGMENTED WASHING MACHINE

(75) Inventors: Michael Wuttikorn Ekbundit, Mount Washington, KY (US); David Scott Dunn, Smithfield, KY (US); Alexander Boris Leibman, Prospect, KY (US); Jerrod Aaron Kappler, Louisville, KY (US)

(73) Assignee: General Electric Company, Schenectady, NY (US)

( * ) Notice: Subject to any disclaimer, the term of this patent is extended or adjusted under 35 U.S.C. 154(b) by 175 days.

(21) Appl. No.: 13/209,611

(22) Filed: Aug. 15, 2011

(65) Prior Publication Data

US 2013/0042656 A1 Feb. 21, 2013

(51) Int. Cl.

| | |
|---|---|
| ***B08B 3/12*** | (2006.01) |
| ***D06B 3/00*** | (2006.01) |
| ***D06B 19/00*** | (2006.01) |
| ***D06B 23/00*** | (2006.01) |
| ***D06F 21/00*** | (2006.01) |
| ***D06F 21/04*** | (2006.01) |
| ***D06F 21/08*** | (2006.01) |
| ***D06F 23/00*** | (2006.01) |
| ***D06F 25/00*** | (2006.01) |
| ***D06F 29/00*** | (2006.01) |
| ***D06F 35/00*** | (2006.01) |
| ***D06F 37/00*** | (2006.01) |

(52) U.S. Cl.

USPC ..... 68/5 C; 8/149.3; 68/5 R; 68/23.5; 68/23.6; 68/23.7; 68/26; 68/58; 68/142; 68/143; 68/154

(58) Field of Classification Search

USPC ..... 68/5 C, 5 R, 23.5–23.7, 26, 58, 142–143, 68/154; 8/149.3

See application file for complete search history.

(56) References Cited

U.S. PATENT DOCUMENTS

| | | | | |
|---|---|---|---|---|
| 2,986,916 | A | 6/1961 | Bouchan | |
| 3,195,327 | A | 7/1965 | Cobb | |
| 3,866,330 | A | 2/1975 | Hooper | |
| 4,519,223 | A * | 5/1985 | Wasemann | 68/23.5 |
| 4,835,994 | A * | 6/1989 | Ishida et al. | 68/174 |
| 7,010,942 | B2 | 3/2006 | Ryu et al. | |
| 7,765,628 | B2 | 8/2010 | Wong et al. | |
| 2007/0283506 | A1 * | 12/2007 | Wong et al. | 8/149.3 |
| 2010/0139334 | A1 * | 6/2010 | Kim et al. | 68/5 C |

* cited by examiner

*Primary Examiner* — Joseph L Perrin
*Assistant Examiner* — Levon J Shahinian
(74) *Attorney, Agent, or Firm* — Dority & Manning, P.A.

(57) ABSTRACT

A steam-augmented washing machine includes a casing, a tub disposed within the casing, and a basket configured for receipt of articles to be washed. A steam generator is disposed within the casing and is in communication with the tub to introduce steam into the wash basket. A plurality of fluid vanes are circumferentially spaced around the side wall adjacent the top end of the wash basket. The fluid vanes have a radial aspect so as to extend radially from side wall, wherein upon rotation of the wash basket within the tub, the fluid vanes generate a circulating vertically oriented steam flow path through the wash basket.

12 Claims, 4 Drawing Sheets

BASKET ASSEMBLY WITH FLUID VANES FOR A STEAM-AUGMENTED WASHING MACHINE

FIELD OF THE INVENTION

The present subject matter relates generally to appliances such as washing machines, and more particularly to a basket assembly for a steam-augmented washing machine that includes fluid vanes for circulating the steam in the wash basket.

BACKGROUND OF THE INVENTION

The use of steam in a washing machine offers various advantages and is gaining wider acceptance. In a pre-wash phase, steam may be introduced with the water to help soak the articles in the wash basket more thoroughly. During the wash phase, steam may be introduced with the detergent to increase the temperature in the wash tub to dissolve the detergent more efficiently, thereby improving the overall cleaning ability of the machine. During the post-wash phase, steam may be added to increase the temperature in the tub to sterilize the articles. The steam also functions to "soften" the clothes articles to remove any hard wrinkles that may have formed while the clothes were tumbled in the tub.

Steam may also serve to reduce water and power consumption of the washing machine by using the steam to heat the wash water instead of an immersion heater. With an immersion heater, a relatively larger volume of water is used than is actually needed for the wash cycle to ensure that the heater remains immersed in water (to prevent damage to the heater). This excess water must also be heated.

While washing machines with steam generators are known and used, the efficiency (and benefits) of these machines depends on large part on the ability to circulate the steam through and around the articles in the wash basket in an efficient manner.

Accordingly, it would be desirable to provide a steam-augmented washing machine with an improved means for generating adequate steam circulation within and around the wash basket.

BRIEF DESCRIPTION OF THE INVENTION

Aspects and advantages of the invention will be set forth in part in the following description, or may be obvious from the description, or may be learned through practice of the invention.

In a particular embodiment, a steam-augmented washing machine appliance, such a consumer washing machine, includes a casing and a tub disposed within the casing. The tub includes a perforated wash basket that is rotatably driven within the tub and configured for receipt of articles to be washed. The wash basket includes a side wall and an open top end through which clothes articles are loaded into the wash basket. A steam generator is disposed within the casing and is in communication with the tub to introduce steam into the wash basket. A plurality of fluid vanes are circumferentially spaced around the side wall adjacent the top end of the wash basket and have a radial aspect so as to extend radially from the side wall. With this configuration, upon rotation of the wash basket within the tub, the fluid vanes generate a circulating vertically oriented steam/air flow path through the wash basket.

It should be understood that "steam" is used herein to include a steam/air fluid flow composition.

In a particular embodiment, the steam generator is disposed so as to introduce steam into the tub at a bottom wall of the wash basket, wherein the steam is drawn into the wash basket through perforations in the side wall and/or bottom wall, or is drawn upwards along the annular space between the wash basket and tub. The fluid vanes are oriented so as to draw the steam vertically through the wash basket in either an upward or downward direction. For example, the fluid vanes may be disposed so as to extend radially inward relative to the side wall and oriented to move the steam through the wash basket in a downward vertical direction, wherein the steam is circulated through the bottom wall of the wash basket and upwards along the annular space between the wash basket and tub. In an alternate configuration, the fluid vanes are disposed so as to extend radially outward relative to the side wall and are oriented to draw the steam through the wash basket in an upward vertical direction, wherein the steam is circulated through a bottom of the wash basket and downwards along the annulus space between the wash basket and tub.

The fluid vanes may be variously configured on the wash basket. or example, in one embodiment, the wash basket includes a balance ring configured thereon at the open top end of the basket, with the fluid vanes defined on the balance ring. The balance ring and fluid vanes may be an integral molded plastic component wherein the vanes are molded directly into the ring, with the balance ring mounted to the basket side wall. In one embodiment, the fluid vanes are formed on an inner circumferential surface of the balance ring so as to extend radially inward relative to the basket side wall and are oriented to move the steam through the wash basket in a downward vertical direction. In another embodiment, the fluid vanes are formed on an outer circumferential surface of the balance ring so as to extend radially outward relative to the side wall and oriented to draw the steam through the wash basket in an upward vertical direction, wherein the steam is circulated through a bottom of the wash basket and downwards along the annular space between the wash basket and tub.

In still a further embodiment, a plurality of the fluid vanes are formed on an inner circumferential surface of the balance ring so as to extend radially inward relative to the side wall, and a plurality of the fluid vanes are formed on an outer circumferential surface of the balance ring so as to extend radially outward relative to the side wall. The sets of fluid vanes are oppositely oriented so as to generate a generally vertical circular flow path for the steam in an upward or downward direction through the wash basket and along the annular space between the wash basket and tub.

The washing machine appliance may be a conventional top load design and include a top lid that closes over the tub. In a closed position, the lid is disposed above the fluid vanes and defines a flow path boundary for the circulating steam. The lid may reflect the steam downward through the wash basket or through the annular space between the wash basket and tub.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
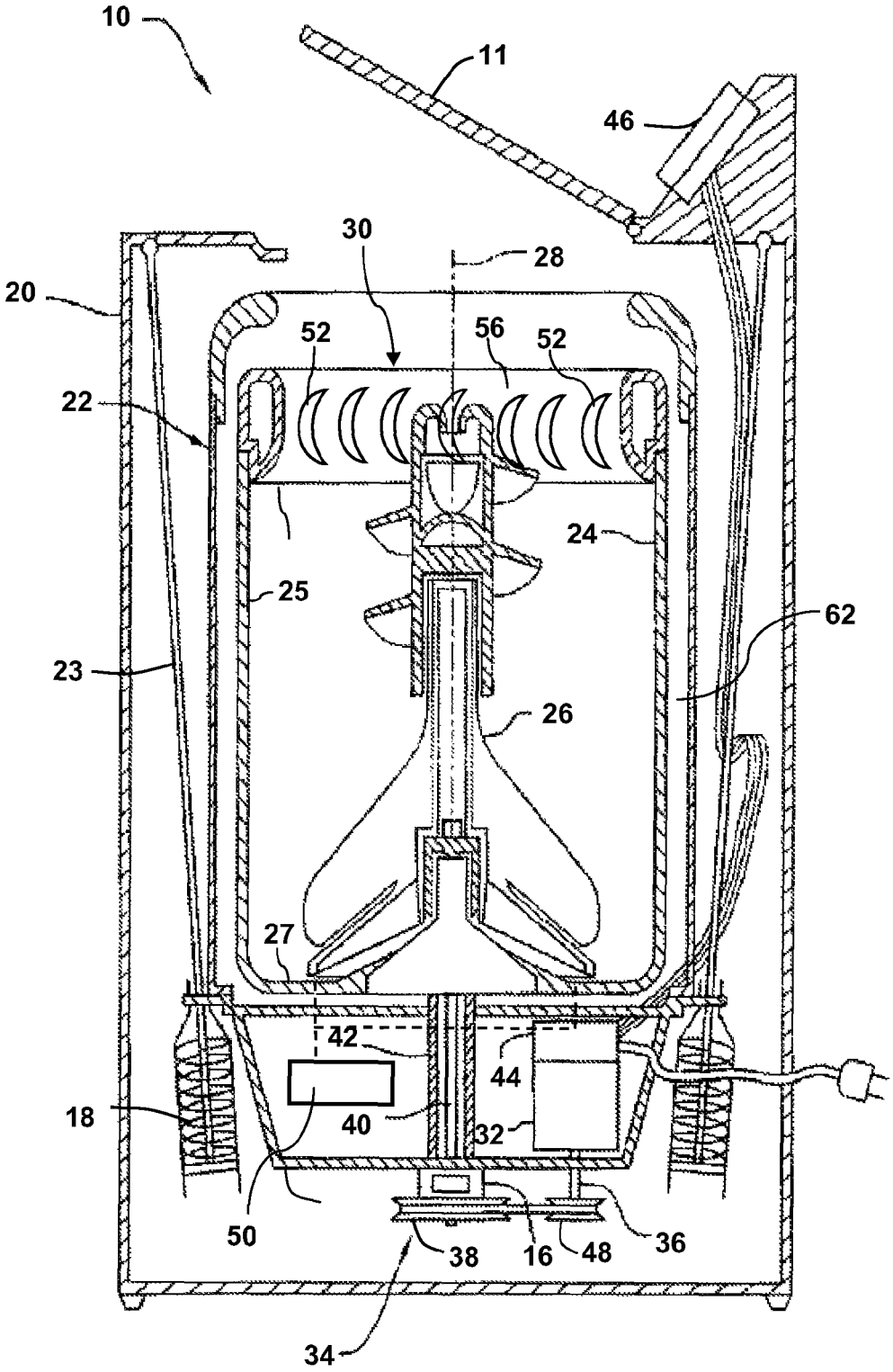
FIG. 1 is a perspective view of an exemplary embodiment of a steam-augmented washing machine in accordance with aspects of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates a conventional-style washing machine 10 that may be configured in accordance with aspects of the invention and is provided for illustrative purposes only to place the present invention in its working environment. It should be appreciated that the invention is not limited to any particular type or style of washing machine 10. In general, such machines 10 are front loading or top-loading (as in FIG. 1) through a lid 11. The machine 10 has an external casing 20 and an internal tub structure 22 suspended by rods 23 with springs 18. A clothes basket 24 and agitator 26 are configured in the tub 22 and rotate relative to an axis 28. The basket 24 has a side wall 24, a bottom 27, and an open top end 30 for receipt of clothes or other articles to be washed. The basket 24 is rotationally driven by a motor 32 via a drive arrangement 34, which may include a pulley 48 mounted to a motor driveshaft 36 and connected by a belt to a pulley 38 that is mechanically linked to the basket driveshaft 40 and spin tube 42. The driveshaft 40 is directly coupled to the pulley 38 and belt, and drives the agitator 26. The spin tube 42 is directly coupled to the basket 24. A clutch 16 locks elements 40 and 42 together during the spin cycle. The motor 32 is controlled by a control unit 44. An operator control panel 46 is provided for the consumer to operate the machine 10 in its various modes.

The washing machine 10 in FIG. 1 may be steam-augmented for any one or combination of purposes recognized, including those discussed above. In this regard, the machine 10 may include any manner of suitable steam generator device 50 operably configured within the casing 20 for producing steam and delivering the steam into the wash basket 24 at the appropriate time during a wash cycle. The use of any number of suitable steam generators 50 is well-known in the art and a detailed description of such devices is not needed for an understanding and appreciation of the present invention. In the depicted embodiment, the steam generator 50 is configured to deliver steam via any manner of suitable conduit into the tub 22 for eventual introduction into the wash basket 24. For example, the steam may be introduced to an annular space 62 between the tub 22 and basket 24, or directly into the basket 24 through the bottom wall 27, side wall 25, or through the open top end 30 of the wash basket 24.

Referring still to FIG. 1, a plurality of fluid vanes 52 are circumferentially spaced around the side wall 25 generally adjacent to the top end 30 (closer to the top end 30 than the bottom wall 27) of the wash basket 24. The fluid vanes 52 may take on various profiles and configurations designed to circulate air and steam as the wash basket 24 rotates, and the invention is not limited to any particular shape or configuration of the fluid vanes 52. In general, the fluid vanes 52 have a radial aspect relative to the axis 28 so as to extend radially (which may include a tangential aspect) away from the basket side wall 25. With this configuration, upon rotation of the wash basket 24 within the tub 22, the fluid vanes 52 generate a circulating, generally vertically oriented steam/air flow path through the wash basket 24. For example, in an embodiment wherein the steam generator 50 is disposed so as to introduce steam into the tub 22 either through or adjacent to the bottom wall 27 of the wash basket 24, the fluid vanes 52 may be oriented so as to draw the steam vertically through the wash basket 24.

Figure 3:
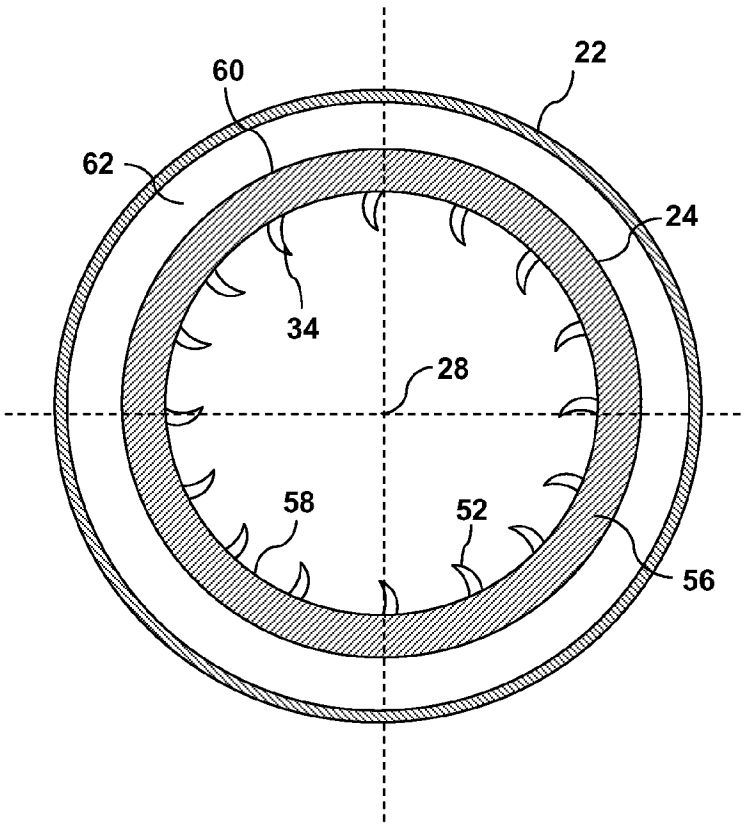
FIG. 3 is a top view of the embodiment of the fluid vanes in FIG. 2.
Figure 2:
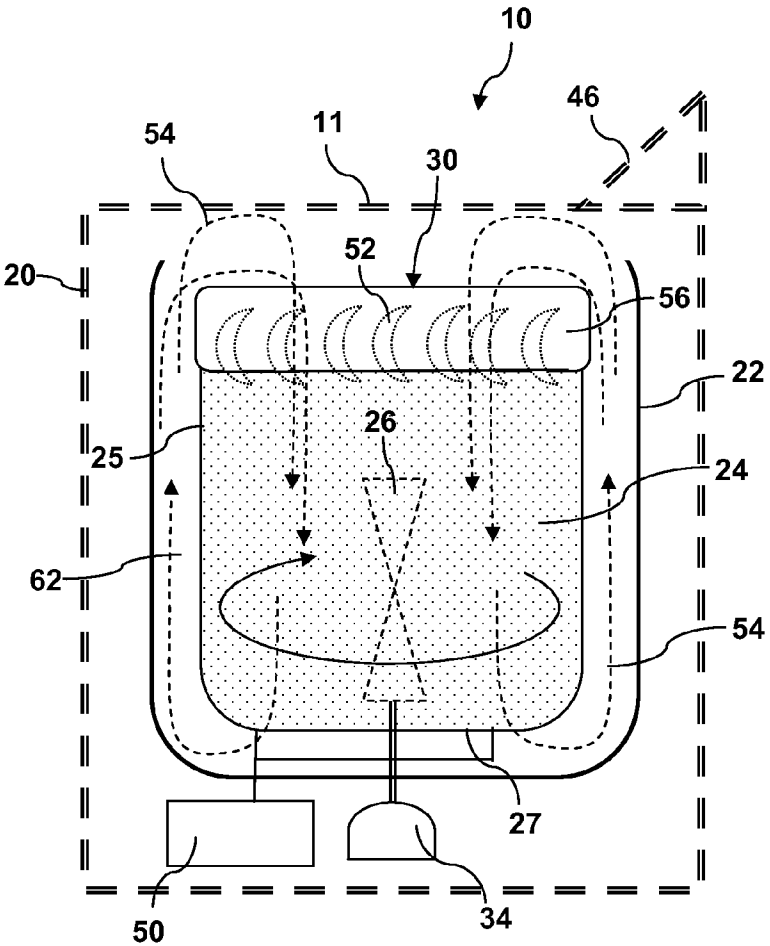
FIG. 2 is a side cut-away view of an embodiment of a washing machine incorporating fluid vanes.

In the embodiment of FIGS. 2 and 3, the fluid vanes 52 are disposed so as to extend radially inward relative to the side wall 25 and are oriented to move the steam/air through the wash basket 24 in a downward vertical direction, as depicted by the dashed flow lines in FIG. 2. The steam/air may be circulated through perforations in the bottom 27 of the wash basket, upwards along the annular space 62, and back into the wash basket 24 through the open top 30, as depicted in FIG. 2.

Figure 5:
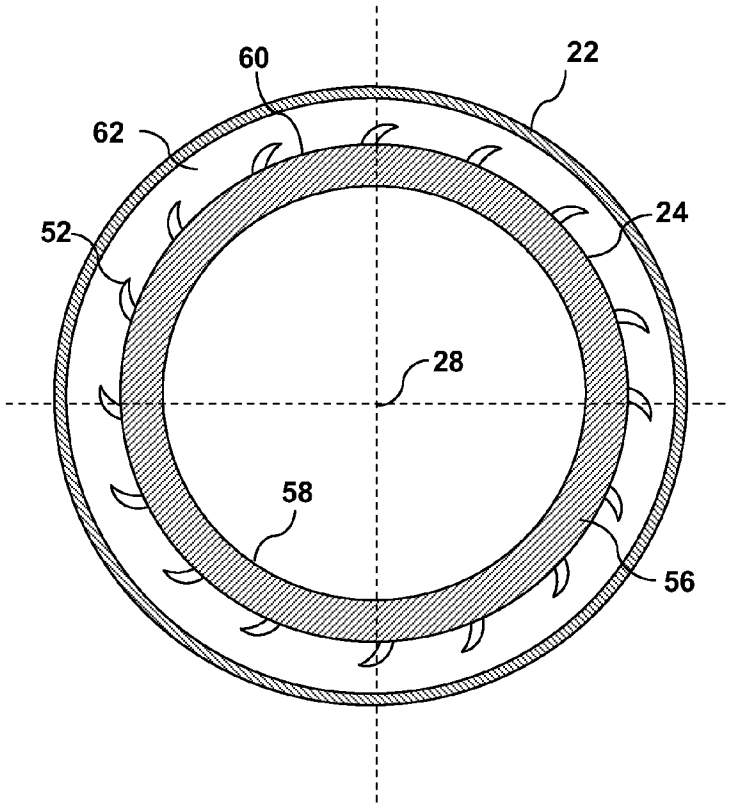
FIG. 5 is a top view of the embodiment of the fluid vanes in FIG. 4.
Figure 4:
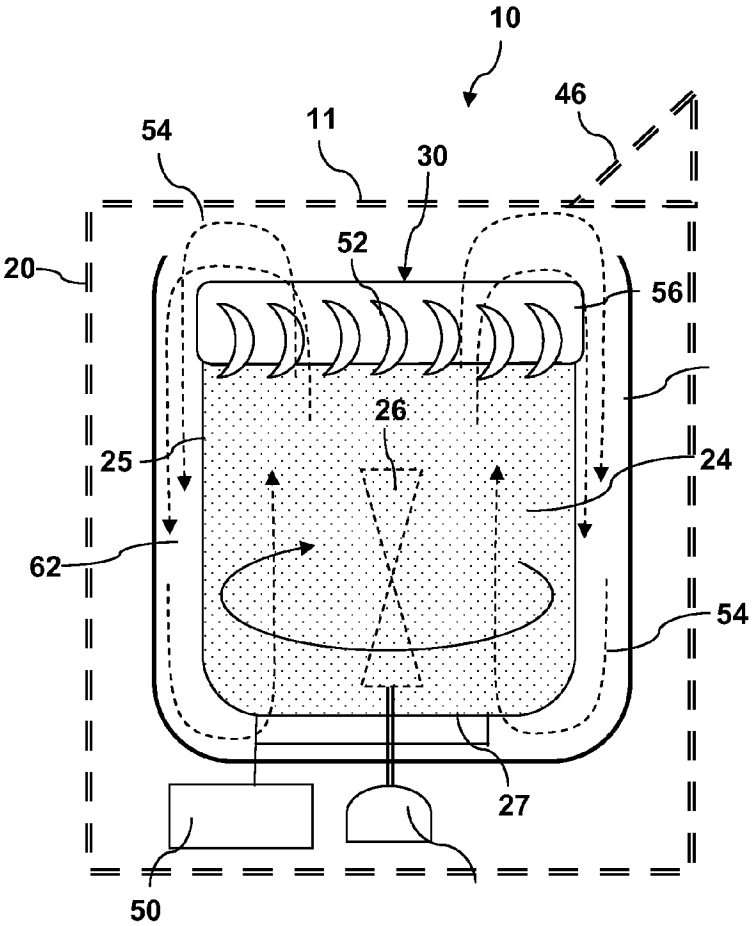
FIG. 4 is a side cut-away view of an alternative embodiment of a washing machine with fluid vanes.

In an alternate embodiment depicted in FIGS. 4 and 5, the fluid vanes 52 are disposed so as to extend radially outward relative to the basket side wall 25. The vanes 52 may be oriented to produce the same steam/air flow path as in FIG. 2, or may be oriented to produce a generally opposite flow path wherein the steam/air is drawn through the wash basket 24 in an upward vertical direction, circulated downwards along the annular space 62, upwards through the bottom 27 of the wash basket 24.

The fluid vanes 52 may be variously configured on the wash basket 24. For example, the vanes 52 may be separately formed and attached to the basket side wall 25. In another embodiment, the vanes 52 may be part of a component that is attached to the wash basket 24. For example, in the illustrated embodiments, the wash basket 24 includes a balance ring 56 mounted to the top end of the side wall 25 so as to define the open top end 30 of the wash basket. The use of a balance ring on a wash basket is well known in the art for maintaining the stability of the wash basket 24 during the various spin modes of the wash cycle. The fluid vanes 52 may be formed as integral projections of the balance ring 56. For example, the balance ring 56 may be a molded plastic component that is fixed to the top end of the wash basket 24, with the fluid vanes 52 being molded directly into the inner circumferential surface 58, outer circumferential surface 60, or both of the circumferential surfaces 58, 60 of the balance ring 56. In another embodiment, the fluid vanes 52 may be separately formed and attached to the balance ring 56.

Figure 7:
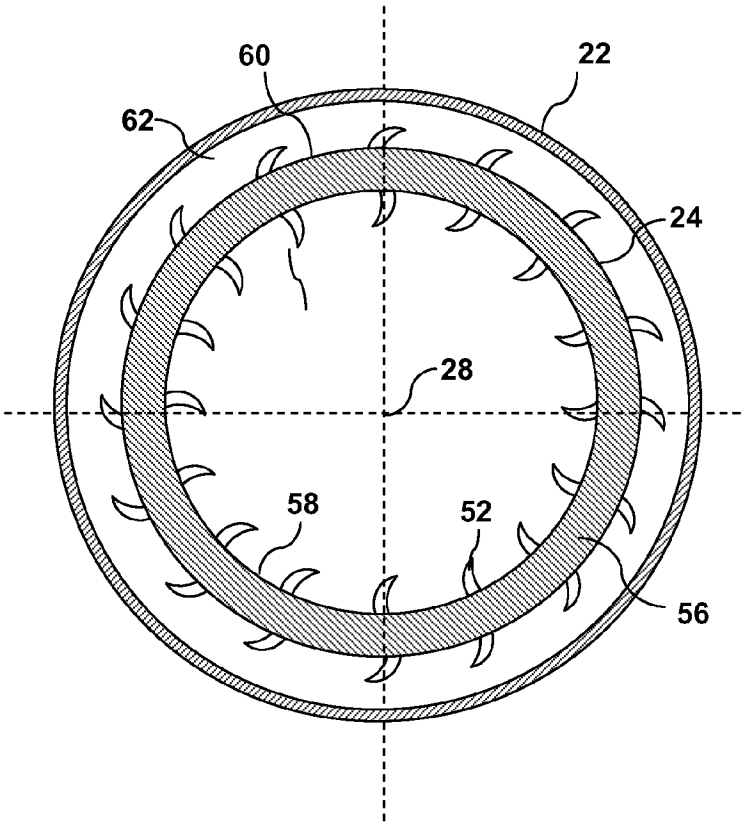
FIG. 7 is a top view of the embodiment of the fluid vanes in FIG. 4.
Figure 6:
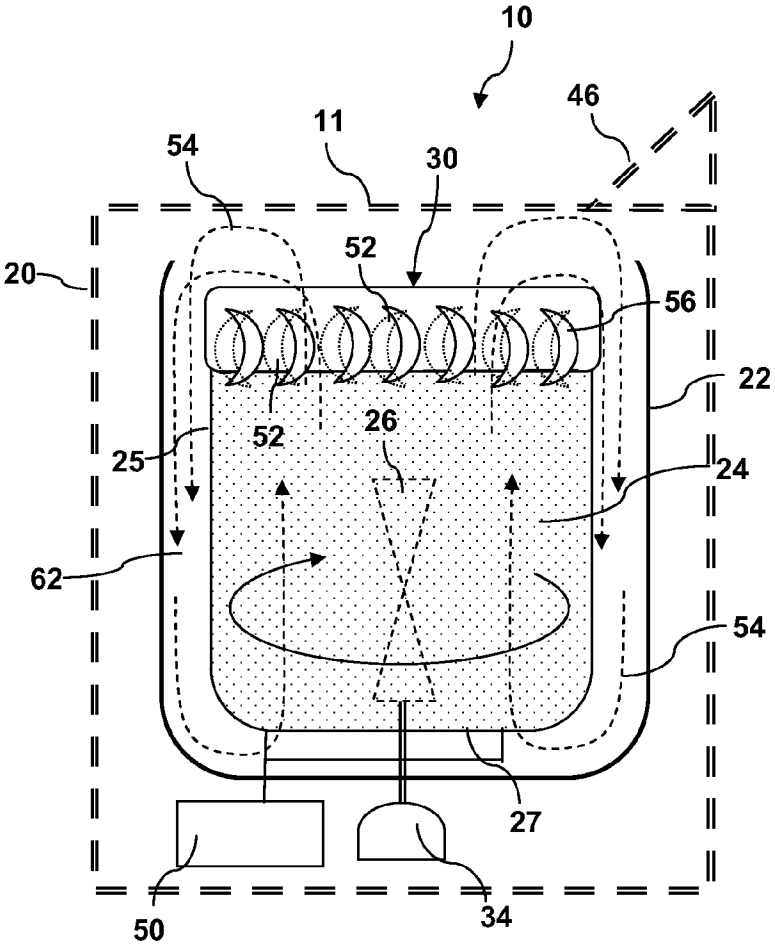
FIG. 6 is a side cut-away view of an alternative embodiment of a washing machine with fluid vanes.

In the embodiment depicted in FIGS. 6 and 7, a plurality of the fluid vanes 52 extend radially inward from the wash basket side wall 25, and a plurality of the vanes 52 extend radially outward from the side wall 25. For example, the vanes 52 may be formed on the inner circumferential surface 58 of the balance ring 56, as well as on the outer circumferential surface 60. The oppositely disposed vanes 52 have a complimentary orientation and profile so as to produce a generally vertically oriented steam/air flow path, which may the path depicted in FIG. 6 or an oppositely directed flow path as depicted in FIG. 2.

If the washing machine 10 is configured as a top loading machine, as depicted in the figures, the top lid 11 may serve to define a portion of the circulating flow path boundary for the steam/air. For example, in the closed position of the lid 11, the steam/air circulated by the fluid vanes 52 may be deflected off of the lid 11 as it changes vertical directions in the tub 22 between one vertical direction through the wash basket 24 and the generally opposite vertical direction through the annular space 62.

Although the fluid vanes 52 are described herein with respect to a steam-augmented washing machine 10, it should be appreciated that the various embodiments of the fluid vanes 52 may also be beneficial in non-steam washing machines. For example, the fluid vanes 52 may be incorporated in any manner of conventional washing machine 10 to establish/maintain a circulating air flow through the wash basket 24, which may be beneficial for any number of reasons, including increased agitation of the clothes articles, less energy and/or water consumption, enhanced cleaning, etc. Thus, the present invention also encompasses any manner of washing machine 10 that incorporates the fluid vanes 52 as set forth herein, regardless of whether or not such machine 10 is steam-augmented.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A steam-augmented washing machine appliance, comprising:

a casing;

a vertical axis tub disposed within said casing, the tub including a rotatable perforated wash basket configured for receipt of articles to be washed;

said wash basket comprising a side wall and an open top end through which clothes articles are loaded into said wash basket;

a steam generator disposed within said casing and in communication with said tub to introduce steam into said wash basket; and a plurality of fluid vanes mounted to said wash basket so as to rotate with said wash basket, said fluid vanes circumferentially spaced around said side wall adjacent said top end of said wash basket, said fluid vanes having a radial aspect so as to extend radially from said side wall, each fluid vane of said fluid vanes shaped and oriented such that said fluid vanes urge steam within the tub to circulate in a forced vertically oriented steam flow path through said wash basket during rotation of said wash basket.

2. The washing machine appliance of claim 1, wherein said steam generator is disposed so as to introduce steam into said tub at a bottom wall of said wash basket, said fluid vanes oriented so as to draw the steam vertically through said wash basket.

3. The washing machine appliance of claim 2, wherein said fluid vanes are disposed so as to extend radially inward relative to said side wall and oriented to move the steam through said wash basket in a downward vertical direction, wherein the steam is circulated through said bottom wall of said wash basket and upwards along an annular space between said wash basket and said tub.

4. The washing machine appliance of claim 2, wherein said fluid vanes are disposed so as to extend radially outward relative to said side wall and oriented to draw the steam through said wash basket in an upward vertical direction, wherein the steam is circulated through said bottom wall of said wash basket and downwards along an annular space between said wash basket and said tub.

5. The washing machine appliance of claim 2, wherein said wash basket further comprises a balance ring configured thereon at said open top end, said fluid vanes defined on said balance ring.

6. The washing machine appliance of claim 5, wherein said balance ring and fluid vanes comprise a molded plastic component that is mounted to said side wall.

7. The washing machine appliance of claim 5, wherein said fluid vanes are formed on an inner circumferential surface of said balance ring so as to extend radially inward relative to said side wall and oriented to move the steam through said wash basket in a downward vertical direction, wherein the steam is circulated through a bottom of said wash basket and upwards along an annular space between said wash basket and said tub.

8. The washing machine appliance of claim 5, wherein said fluid vanes are formed on an outer circumferential surface of said balance ring so as to extend radially outward relative to said side wall and oriented to draw the steam through said wash basket in an upward vertical direction, wherein the steam is circulated through a bottom of said wash basket and downwards along an annular space between said wash basket and said tub.

9. The washing machine appliance of claim 5, wherein a plurality of said fluid vanes are formed on an inner circumferential surface of said balance ring so as to extend radially inward relative to said side wall and a plurality of said fluid vanes are formed on an outer circumferential surface of said balance ring so as to extend radially outward relative to said side wall, wherein said fluid vanes are oriented to generate a generally vertical circular flow path for the steam in an upward or downward direction through said wash basket.

10. The washing machine appliance of claim 1, further comprising a top lid that closes over said tub, said lid disposed above said fluid vanes in a closed position of said lid, wherein said lid defines a flow path boundary for the circulating steam and deflects the steam downward through said wash basket or through an annular space between said wash basket and said tub.

11. The washing machine appliance of claim 1, wherein said fluid vanes define an arcuate cross-section along the radial aspect of said fluid vanes.

12. The washing machine appliance of claim 1, wherein said wash tub is configured for rotating about a vertical axis in said tub, said fluid vanes defining an arcuate cross-section in a plane that is perpendicular to the vertical axis.

* * * * *